US005239278A

United States Patent [19]

Andres

[11] Patent Number: 5,239,278

[45] Date of Patent: Aug. 24, 1993

[54] TRANSFORMER AND MOUNTING BRACKET ASSEMBLY

[75] Inventor: Clete Andres, Edwardsville, Ill.

[73] Assignee: Basler Electric Company, Highland, Ill.

[21] Appl. No.: 803,524

[22] Filed: Dec. 9, 1991

[51] Int. Cl.[5] ..... H01F 15/02; H01F 27/04

[52] U.S. Cl. ..... 336/65; 174/52.1; 248/27.3; 336/67; 336/98

[58] Field of Search ..... 336/65, 67, 68, 210, 336/90, 98; 174/52.1; 248/27.3

[56] References Cited

U.S. PATENT DOCUMENTS

| | | | |
|---|---|---|---|
| 2,141,141 | 12/1938 | Kongsteel | 336/98 |
| 2,431,189 | 11/1947 | Moreton et al. | 175/356 |
| 2,433,511 | 12/1947 | Goddard | 174/52 |
| 2,494,350 | 1/1950 | Mittenmaier | 336/65 |
| 2,672,578 | 3/1954 | Verkuil | 336/98 |
| 2,819,331 | 1/1958 | Bladh | 174/52 |
| 2,903,661 | 9/1959 | Goffstein | 336/65 |
| 3,134,467 | 5/1964 | Blyth | 336/65 |
| 3,144,503 | 8/1964 | Fishcer | 174/52 |
| 3,321,168 | 5/1967 | D'Entremont | 248/346 |
| 3,965,287 | 6/1976 | Mueller | 174/66 |
| 4,899,122 | 2/1990 | Sommer | 336/210 |

*Primary Examiner*—Thomas J. Kozma

*Attorney, Agent, or Firm*—Senniger, Powers, Leavitt & Roedel

[57] ABSTRACT

A transformer assembly having a mounting plate of electrically conductive material An electrically conductive core of a transformer has an end mounted on the plate and electrically connected to the plate. A fastener on the plate engages an opening in a junction box. The plate provides an electrical connection between the core and the junction box to ground the transformer to the junction box. The transformer has a coil on the core, the coil having wires adapted to be connected to the terminal wires in the box. The plate and the fastener support the plate and transformer on the junction box.

16 Claims, 3 Drawing Sheets

TRANSFORMER AND MOUNTING BRACKET ASSEMBLY

BACKGROUND OF THE INVENTION

The present invention relates generally to transformers and mounting brackets therefor. More particularly, the present invention relates to a transformer and bracket capable of being mounted to a terminal junction box or electrical enclosure.

Presently, there are mounting brackets for transformers which mount the transformer to terminal junction boxes. An example of such a mounting bracket is shown in Pat. No. 2,819,331, in which a transformer having a coil is securely fastened to one side of the mounting bracket by spot welding or rivets. In this patent, the mounting bracket is welded to a metal cap attached to the transformer which protects its coil. The mounting bracket consists of two legs centrally located on the other side of the bracket from which the transformer is mounted. The two legs are received in a knock out hole located within the junction box, the hole being just large enough to accommodate the legs. One leg has located therein a tapped hole in which a screw secures the bracket to the junction box, the other leg engages an edge of the opening. With this arrangement, it is often difficult to access the leg having the tapped hole for fastening the transformer to the junction box. Often, it is the leg that is not tapped which is more accessible for securing the mounting bracket than the leg having the tapped hole. Additionally, it is difficult to obtain the proper orientation for positioning the transformer and its secondary terminals which typically extend from the cap protecting the other side of the coil opposite the cap having the bracket.

SUMMARY OF THE INVENTION

Among the several objects of this invention may be noted the provision of an improved transformer assembly which may be mounted in any orientation with respect to a terminal junction box; the provision of such a transformer assembly which may be mounted to a conduit opening of a terminal junction box; the provision of such a transformer assembly which is easily mounted to a terminal junction box; the provision of such a transformer assembly having a low cost, non-conductive cap or cover protecting the coil of the transformer from unwanted elements which may damage the transformer coil; the provision of such a transformer assembly which is adequately grounded to the junction box; and the provision of a transformer assembly which is easy to manufacture and economical to make.

Generally, a transformer assembly according to the principles of the present invention comprises a plate of electrically conductive material and a transformer having an electrically conductive core having an end mounted on the plate thereby electrically connected to the plate. The plate provides an electrical connection between the core and the box to ground the transformer to the terminal junction box. The transformer has a coil on the core, the coil having wires adapted to be connected to the terminal wires in the box. Means on the plate engages the opening in the junction box. The plate and the engaging means support the plate and transformer on the junction box.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
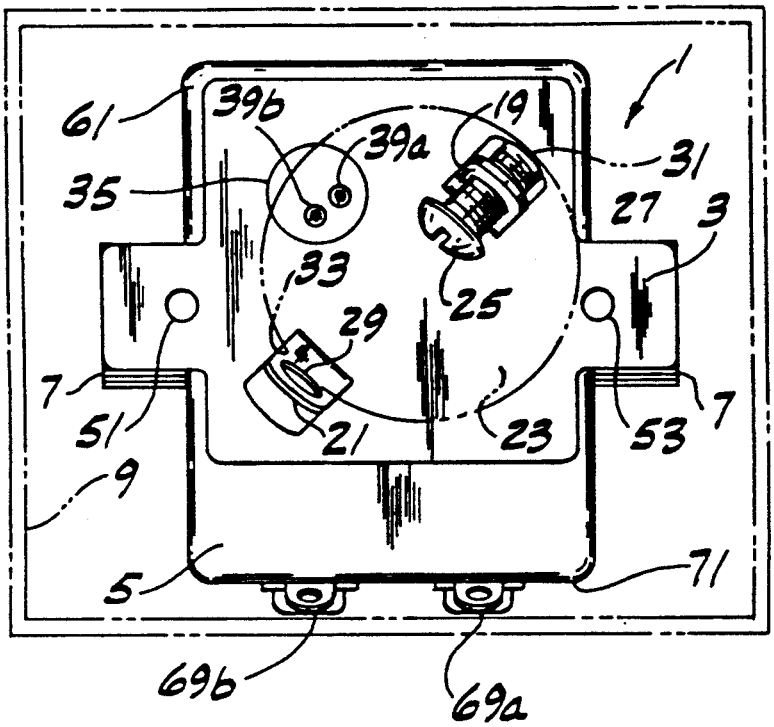
FIG. 1 is a front elevation illustration of one preferred embodiment of a transformer and bracket assembly of the present invention mounted to a junction box (shown in phantom)
Figure 2:
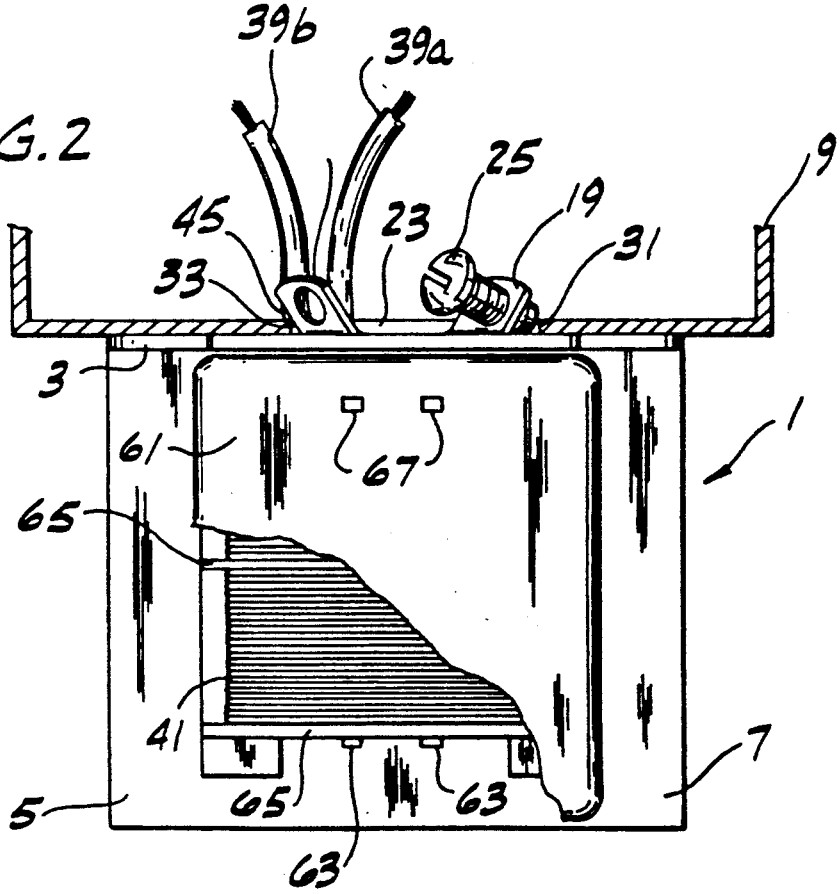
FIG. 2 is an inverted top elevation illustration with part broken away of the transformer and bracket assembly of FIG. 1.

Referring now to the drawings, FIGS. 1 and 2 illustrate a transformer and mounting bracket assembly 1 of the present invention capable of being mounted to a terminal junction box 9. A mounting bracket 3 is securely fastened to a transformer 5 having a core 7 and mounted to the terminal junction box 9. The mounting bracket 3 and junction box 9 are usually made from sheet metal or other electrically conductive material. Mounting bracket 3 comprises a plate 11 of general rectangular shape having two opposing surfaces 15, 17 (see FIG. 4). Surface 15 is adapted to receive and be mounted to transformer 5.

In one preferred embodiment, two tabs 19, 21, located on the other surface 17 are positioned generally opposite one another on plate 11 along an axis A. The tabs 19, 21 extend at an angle A to the plate 11 and in a direction away from each other (see FIG. 4). In this preferred embodiment, tabs 19, 21 are integrally formed and punched from plate 11 to extend at angle B to the plate. However, it is to be understood that other means for providing tabs, such as welding the tabs onto the plate, may be provided.

A knockout hole 23 located in the terminal junction box 9 receives tabs 19, 21 for securing the transformer to the junction box as illustrated in FIG. 2. The hole 23 may be formed from one of many knockouts located on the junction box 9. Tabs 19, 21 are spaced wide enough to accommodate the insertion of the tabs 19, 21 within the hole. A screw fastener 25 secures the mounting bracket 3 to the junction box 9. After inserting tabs 19, 21 within hole 23 and placing the mounting bracket 3 against the junction box, the screw fastener 25 engages one of two tapped holes 27, 29 located generally centrally on the tabs along axis A. Preferably, tabs 19, 21 form an angle of 60 degrees (see FIG. 4) to the plane of the plate 11. As a result, the screw fastener 25, upon being screwed into tapped holes 27, engages an edge 31 of knockout hole 23 forcing the opposing tab 21 to engage an opposite edge 33 of the hole. Depending on the angle or the accessibility of tabs 19, 21, either tab may be used for fastening the transformer 1 to the junction box 7.

An opening 35 is provided in mounting bracket 3 for connecting the wires of transformer 5 to the terminal wires (not shown) located in junction box 9. A coil 41 wrapped around transformer core 7 has two primary lead connecting wires 39*a*, 39*b* extending from the core. Wires 39*a*, 39*b* are for connection to terminal wires in the junction box 9. Knockout hole 23 located in the junction box is at least partially in registry with the mounting bracket opening 35. Wires 39*a*, 39*b* pass through knockout hole 23 and opening 35, thereby facilitating the connection of the transformer to the terminal wires in the junction box.

Figure 3:
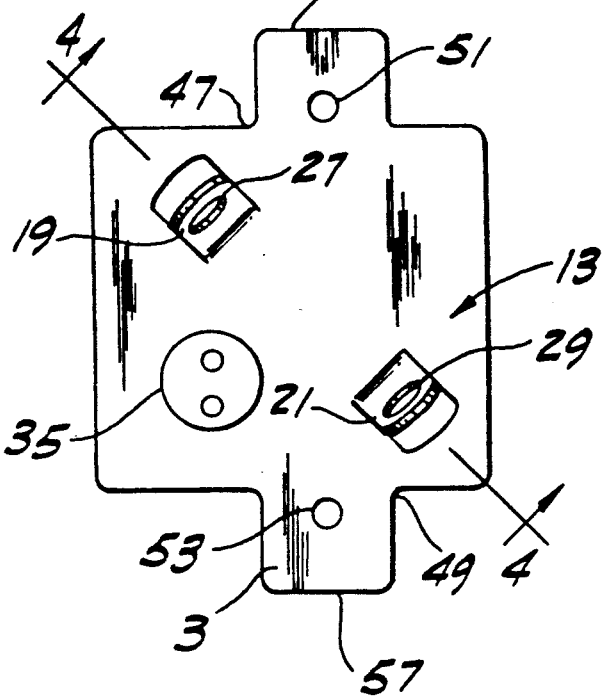
FIG. 3 is a front elevation illustration of one preferred embodiment of a mounting bracket of the invention.
Figure 4:
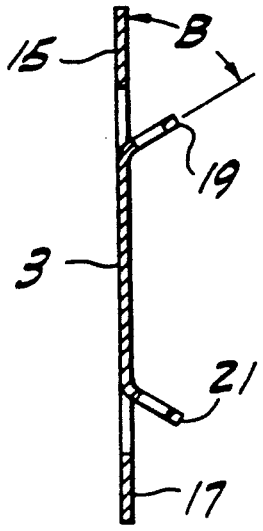
FIG. 4 is a cross-sectional view taken on line 4—4 of FIG. 3.

FIGS. 3 and 4, illustrate the mounting bracket 3 in which plate 11 has two ends 47, 49. Plate 11 has located therein two welding apertures 51, 53, one aperture 51 located closely adjacent first end 47, and the other aperture 53 located closely adjacent the second end 49. In this embodiment, the mounting bracket 3 is secured to transformer 5 preferably by TIG welding the mounting bracket to the core 7 of the transformer as shown in FIG. 2. In the past, the mounting bracket was typically welded to an electrically conductive cap which protected the core 5 of the transformer. However, the present mounting bracket is adapted to be welded directly to the core of the transformer. Apertures 51, 53 facilitate the welding procedure by providing a convenient opening for locating the welds. Mounting bracket 3 includes two extensions 55, 57 extending from the ends 47, 49, having apertures 51, 53, located therein for fastening the transformer to the mounting bracket.

Welding mounting bracket 3 to the end of core 7 of transformer 5 is particularly desirable because bracket 3 effectively grounds the transformer 5 to junction box 9. In particular, the core 7, (see FIG. 1), is electrically grounded to mounting bracket 3, which in turn is grounded to junction box 9. Before the present invention, a sheet metal cap or cover was provided for protecting the coil from unwanted contact. The sheet metal cap was necessary because the mounting bracket was fastened, welded or riveted to the cap instead of the core as in the present invention. In the present invention, transformer 5 is properly grounded to junction box 9 through mounting bracket 3 so that a non-conductive cap 61 may be provided in place of the conductive cap for protecting and enclosing the coil 41.

Figure 5A:
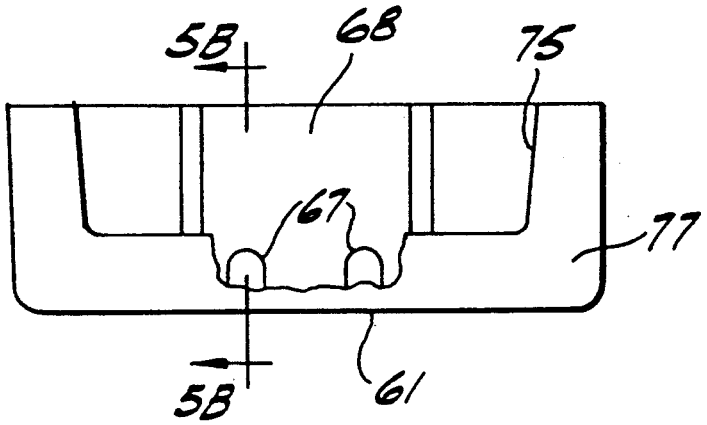
FIG. 5A is a top elevation illustration with part broken away of a cap.
Figure 5B:
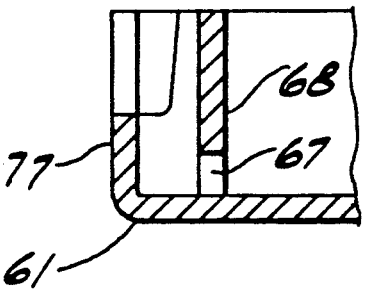
FIG. 5B is a cross-sectional view of the cap taken along line 5B—5B of FIG. 5A.

Cap 61 may be made from a plastic or like non-conductive material and is adapted to protect primary lead wires 39*a*, 39*b* for passing through opening 35 (see FIGS. 5A and 5B). Resilient latch fasteners 63 extending from a plurality of resilient walls 65 (see FIG. 2), which in turn extend perpendicularly from core 7, releasably secure cap 61 to the core of the transformer 5. Fasteners 63 engage and secure receiving notches 67 located on an interior wall 68 of cap 61. A notch 75 is further provided through an exterior wall 77 extending along the peripheral edges and perpendicular to the generally horizontally disposed cap which allows the passage of wires 39*a*, 39*b* for connecting the transformer to the junction box 9. Wall 77 forms an enclosure with the core 7 and the plate 11 within which the primary connecting lead wires 39*a*, 39*b* are located. Secondary terminals 69*a*, 69*b* located on the surface of an opposing cap 71 of transformer 5 are provided for connection to wires of a device such as a low voltage doorbell. Cap 71 may be secured to the transformer 5 by a latch fastener similar to fastener 63.

Figure 7:
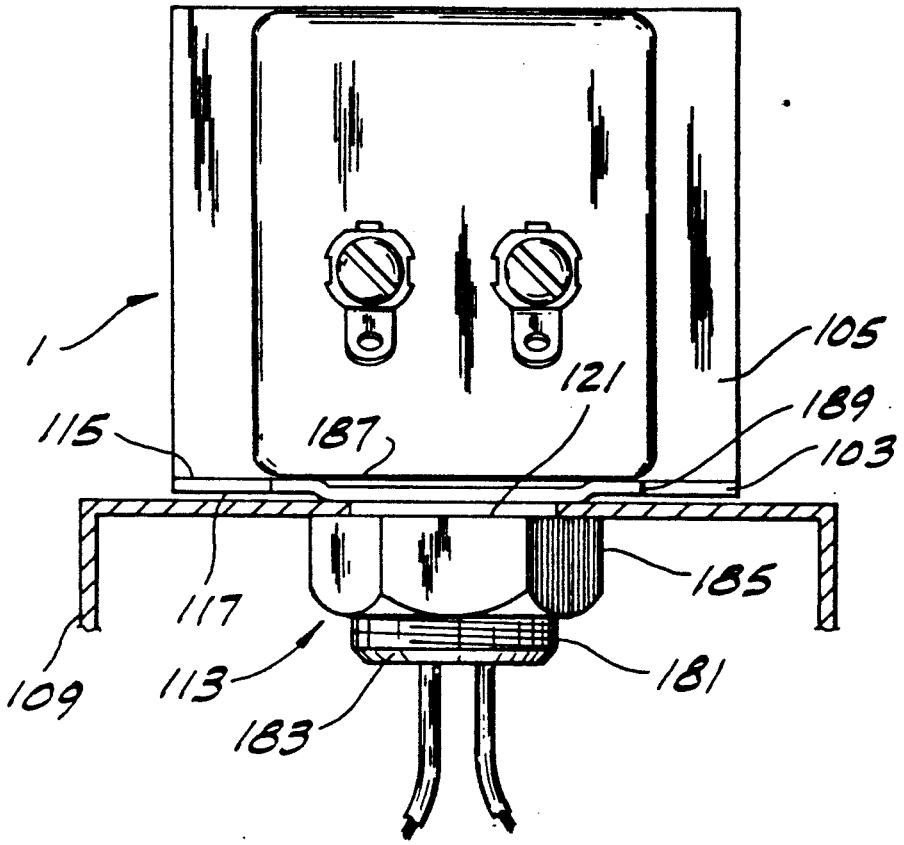
FIG. 7 is a top elevation illustration of the transformer and bracket assembly only shown in FIG. 6.
Figure 6:
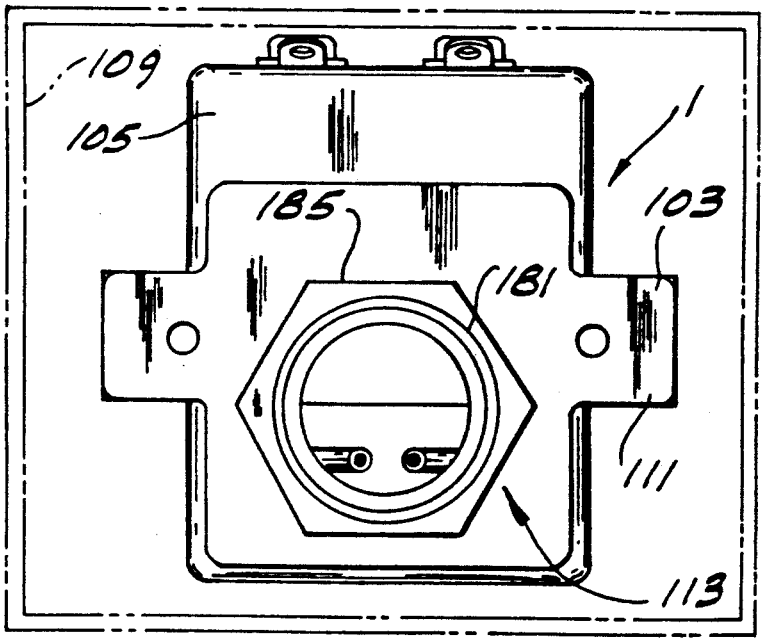
FIG. 6 is a front elevation illustration of one preferred embodiment of a transformer and bracket assembly of the present invention mounted to a junction box.

In another preferred embodiment, as shown in FIGS. 6 and 7, a mounting bracket 103 is welded to the core of a transformer 105. Mounting bracket 103 comprises a plate 111 and a connector for fastening the mounting bracket to a junction box 109, generally indicated at 113. Plate 111 has two opposing surfaces 115, 117. Surface 115 is adapted to receive and mount to transformer 105. Fastening connector 113, located on surface 117, comprises a tubular male conduit fitting 181 having a threaded outer surface 183. Fitting 181 is generally centrally mounted on mounting bracket 103 and adapted to fit within a knockout hole 121 of the terminal junction box 109. Mounting bracket 103 is fastened to junction box 109 by screw fastening a nut 185 on to threaded surface 183 of fitting 181. By crimping an edge 187 of fitting 181 within an opening 189 located in mounting bracket 103, the fitting 181 is securely fastened to the mounting bracket. However, it is to be understood that other means of securing fitting 181 to mounting bracket 103 may be used.

In operation, the transformer and mounting bracket assembly are assembled and attached to a terminal junction box as follows. First, a mounting bracket 3 is welded to the core 7 of a transformer 5. With this configuration, plastic non-conductive caps may be fastened to the transformer for protecting coil 41. Next, the fastener is inserted into a knockout hole 121 in the terminal junction box for fastening. For a mounting bracket having tabs as its fastener, the tabs are inserted into the knockout hole. A screw fastener engaging one of the tapped holes located in the tabs is screwed into the tapped hole until its end engages an edge of the knockout hole. As a result, the opposite tab engages the opposite edge of the knockout hole for securing the assembly to the junction box. For a mounting bracket having a conduit fitting as its fastener, the fitting is inserted into the knockout hole and a nut is threaded onto it to fasten the assembly to the junction box. Terminal connecting wires in the junction box are then connected to wires extending from the transformer coil. The assembly is adequately grounded because the conductive mounting bracket forms an electrical connection between the core and the conductive junction box.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A transformer of the type adapted to be secured to an opening, such as a conduit opening, located in a terminal junction box, the junction box having terminal wires therein for connection to the transformer, the transformer comprising:

an electrically conductive core;

a coil on the core, the coil having wires adapted to be connected to the terminal wires in the junction box;

a substantially flat plate of electrically conductive material having an opening receiving the coil wires, said plate mounted on and engaging the core and electrically connected to the core, the plate being adapted to support the core on the junction box and provide an electrical connection between the core and the junction box to ground the transformer to the junction box; and means on the plate for engaging the opening in the junction box, said engaging means adapted to support the plate, core and coil on the junction box such that the opening in the plate is at least partially in registry with the opening in the junction box and such that the coil wires are positioned in the plate opening and in the opening in the junction box for connection to the terminal wires.

2. A transformer as set forth in claim 1 wherein said engaging means comprises a screw and two tabs generally opposite one another on the plate, the tabs extending at an angle to the plate and in a direction away from each other, the tabs being adapted to be received in the opening in the terminal junction box, each tab having a tapped hole for receiving the screw whereby the screw may engage the tapped hole of either tab to secure the transformer to the junction box by engaging an edge defining the opening in the junction box thereby forcing the opposing tab to engage the opposite edge of the opening.

3. A transformer as set forth in claim 2 wherein the tabs and plate are integrally formed from a single piece of material.

4. A transformer as set forth in claim 3 wherein the tabs form an angle of approximately sixty degrees to the plane of the plate.

5. A transformer as set forth in claim 1 wherein said engaging means comprises a conduit fitting on the plate, the fitting being adapted to be received in the opening in the terminal junction box.

6. A transformer as set forth in claim 5 wherein the plate has an opening defined by an edge and wherein the conduit fitting is secured to the plate by crimping an end of the fitting to the edge defining the opening located within the plate.

7. A transformer as set forth in claim 6 wherein the conduit fitting is a tubular shaped member having external threads and further comprising a nut for engaging the threads to secure the fitting within the opening in the junction box.

8. A transformer as set forth in claim 1 wherein the plate has two openings, the plate being welded to the core through the openings.

9. A transformer as set forth in claim 1 further comprising an electrically non-conductive cap positioned contiguous to the core and covering the coil of the transformer, said cap and said core forming an enclosure for enclosing the coil and the wires between the coil and the plate thereby protecting and isolating the coil of the transformer.

10. A transformer as set forth in claim 9 wherein the cap includes a notch for receiving the coil wires connected to terminal wires in the junction box, and a wall adjacent the notch forming an enclosure with the core and the plate within which the coil wires are located.

11. A grounded transformer assembly which is part of an electrical system of wires including a grounded wire, the assembly comprising:

a terminal junction box receiving the wires of the electrical system and electrically connected to the grounded wire of the electrical system, the junction box having an opening, such as a conduit opening, located therein;

a a substantially flat plate of electrically conductive material;

a transformer having an electrically conductive core having an end fixedly mounted on and engaging the plate and electrically connected to the plate, the plate providing an electrical connection between the core and the junction box to ground the transformer to the terminal junction box, the transformer having a coil on the core, the coil having wires connected to the wires in the junction box; and means on the plate for engaging the opening in the junction box, said engaging means supporting the plate and transformer on the junction box.

12. A transformer as set forth in claim 11 further comprising an electrically non-conductive cap positioned contiguous to the core and covering the coil of the transformer, said cap and said core forming an enclosure for enclosing the coil and the wires between the coil and the plate thereby protecting and isolating the coil of the transformer.

13. A transformer as set forth in claim 12 wherein the cap includes a notch for receiving the coil wires connected to the wires in the junction box, and a wall adjacent the notch forming an enclosure with the core and the plate within which the coil wires are located.

14. A device of the type adapted for securing in an opening, such as a conduit opening, located in a terminal junction box having terminal wires therein, the device comprising:

a substantially flat plate;

a screw and two tabs for fastening the plate to the junction box, the tabs positioned generally opposite one another on the plate, the tabs extending at an angle to the plane of the plate and in a direction away from each other, the tabs being adapted to be received in the opening in the junction box, each tab having a tapped hole for receiving a screw whereby the screw may engage either tab to secure the device to the junction box; and a transformer having an electrically conductive core having an end mounted on and engaging the plate and electrically connected to the plate, the plate for providing an electrical connection between the core and the junction box to ground the transformer to the junction box, the transformer having a coil on the core, the coil having wires adapted to be connected to the terminal wires in the junction box.

15. A grounded transformer assembly as set forth in claim 11 wherein the plate is mounted on and engages the core of the transformer by a weld between the plate to the core.

16. A grounded transformer assembly as set forth in claim 11 wherein the plate has an opening at least partially in registry with the opening in the junction box and wherein the coil wires are positioned in the plate opening so that, when the engaging means engages the opening in the junction box, the coil wires are positioned within the opening in the junction box for connection to the wires of the electrical system.

* * * * *